US011221004B2

(12) United States Patent
Gledhill, III et al.

(10) Patent No.: US 11,221,004 B2
(45) Date of Patent: Jan. 11, 2022

(54) MULTIPLE DIAPHRAGM PUMP

(71) Applicant: BLUE-WHITE INDUSTRIES, LTD., Huntington Beach, CA (US)

(72) Inventors: Robert E. Gledhill, III, Huntington Beach, CA (US); John Nguyen, Fountain Valley, CA (US)

(73) Assignee: Blue-White Industries, Ltd., Huntington Beach, CA (US)

( * ) Notice: Subject to any disclaimer, the term of this patent is extended or adjusted under 35 U.S.C. 154(b) by 499 days.

(21) Appl. No.: 15/963,770

(22) Filed: Apr. 26, 2018

(65) Prior Publication Data

US 2019/0017499 A1 Jan. 17, 2019

Related U.S. Application Data

(60) Provisional application No. 62/535,159, filed on Jul. 20, 2017, provisional application No. 62/531,733, filed on Jul. 12, 2017.

(51) Int. Cl.

| | |
|---|---|
| ***F04B 43/02*** | (2006.01) |
| ***F04B 7/00*** | (2006.01) |
| ***F04B 53/10*** | (2006.01) |
| ***F04B 35/04*** | (2006.01) |
| ***F04B 9/04*** | (2006.01) |

(52) U.S. Cl.

CPC ..... *F04B 43/025* (2013.01); *F04B 7/0065* (2013.01); *F04B 9/042* (2013.01); *F04B 35/04* (2013.01); *F04B 53/10* (2013.01); *F04B 2201/06* (2013.01)

(58) Field of Classification Search

CPC ..... F04B 43/025; F04B 9/042; F04B 7/0065; F04B 53/10; F04B 35/04; F04B 2201/06; F03B 43/02; F03B 43/023

USPC ..... 417/375, 415, 418, 413.1

See application file for complete search history.

(56) References Cited

U.S. PATENT DOCUMENTS

| | | | |
|---|---|---|---|
| 2,139,571 | A | 12/1938 | Avigdor |
| 2,483,218 | A | 9/1949 | Meath |
| 2,605,711 | A | 8/1952 | Audemar |
| 3,816,029 | A | 6/1974 | Bowen et al. |

(Continued)

FOREIGN PATENT DOCUMENTS

| | | | |
|---|---|---|---|
| DE | 200 08 188 | U1 | 10/2000 |
| GB | 2177758 | A | 1/1987 |
| JP | 2005-291010 | A | 10/2005 |

*Primary Examiner* — Charles G Freay
*Assistant Examiner* — Lilya Pekarskaya
(74) *Attorney, Agent, or Firm* — Knobbe, Martens, Olson & Bear, LLP

(57) ABSTRACT

A diaphragm pump assembly can include a pump drive chamber, a first pump diaphragm chamber, and a second pump diaphragm chamber. The assembly can include a pump motor configured to rotate a motor shaft extending into the pump drive chamber. The assembly can include a cam connected to the motor shaft and configured to rotate in response to rotation of the motor shaft. The assembly can include a drive yoke having a yoke frame and a yoke pocket having a first wall and a second wall parallel and opposite the first wall. First and second pistons can connect to the drive yoke and to first and second diaphragms, respectively. The diameter of the cam can be less than and within 5% the width of yoke pocket and the yoke can be configured to move the pistons along a straight line.

13 Claims, 9 Drawing Sheets

(56) References Cited

U.S. PATENT DOCUMENTS

| | | | | |
|---|---|---|---|---|
| 4,028,018 | A | 6/1977 | Audsley | |
| 4,850,817 | A * | 7/1989 | Nason | A61M 5/14216 417/362 |
| 5,649,809 | A | 7/1997 | Staplefeldt | |
| 6,901,960 | B2 | 6/2005 | Roberts et al. | |
| 7,001,153 | B2 | 2/2006 | McDowell et al. | |
| 7,284,964 | B2 | 10/2007 | McDowell et al. | |
| 7,726,954 | B2 * | 6/2010 | Ben-Yosef | F04B 43/02 417/359 |
| 8,215,931 | B2 | 7/2012 | McDowell et al. | |
| 8,418,364 | B2 | 4/2013 | McDowell et al. | |
| 8,469,681 | B2 * | 6/2013 | Wheal | F04B 43/0736 417/395 |
| 8,474,365 | B2 * | 7/2013 | Kaufmann | F04B 43/025 92/72 |
| 8,639,363 | B2 | 1/2014 | Gledhill, III et al. | |
| 9,374,024 | B2 | 6/2016 | Nguyen et al. | |
| 9,389,109 | B2 | 7/2016 | Gledhill, III et al. | |
| 9,639,185 | B2 * | 5/2017 | McClain | G06F 3/03549 |
| 9,777,720 | B2 | 10/2017 | Gledhill, III et al. | |
| 9,828,984 | B2 | 11/2017 | Gledhill, III et al. | |
| 9,909,579 | B2 | 3/2018 | Gledhill, III et al. | |
| 9,996,089 | B2 | 6/2018 | Gledhill, III et al. | |
| 10,330,094 | B2 | 6/2019 | Gledhill, III et al. | |
| 10,948,320 | B2 | 3/2021 | Gledhill, III et al. | |
| 2010/0005655 | A1 | 1/2010 | Nguyen | |
| 2011/0180172 | A1 | 7/2011 | Gledhill, III et al. | |
| 2015/0211509 | A1 * | 7/2015 | Gledhill, III | F04B 43/026 417/413.1 |
| 2015/0226192 | A1 | 8/2015 | Hines et al. | |
| 2018/0087942 | A1 | 5/2018 | Gledhill, III et al. | |
| 2018/0291886 | A1 | 10/2018 | Gledhill, III et al. | |
| 2018/0298891 | A1 | 10/2018 | Gledhill, III et al. | |
| 2019/0017499 | A1 | 1/2019 | Gledhill, III et al. | |
| 2019/0234394 | A1 | 8/2019 | Gledhill, III et al. | |
| 2020/0149522 | A1 | 5/2020 | Gledhill, III et al. | |
| 2020/0386593 | A1 | 12/2020 | Nguyen et al. | |
| 2021/0047209 | A1 | 2/2021 | Gledhill, III et al. | |
| 2021/0054963 | A1 | 2/2021 | Nguyen et al. | |
| 2021/0064735 | A1 | 3/2021 | Gledhill, III et al. | |

* cited by examiner

MULTIPLE DIAPHRAGM PUMP

CROSS-REFERENCE TO RELATED APPLICATIONS

This application claims the benefit of U.S. Provisional Application No. 62/531,733, filed Jul. 12, 2017, titled MULTIPLE DIAPHRAGM PUMP, and of U.S. Provisional Application No. 62/535,159, filed Jul. 20, 2017, titled MULTIPLE DIAPHRAGM PUMP. The entire contents of each of the above-identified patent applications are incorporated by reference herein and made a part of this specification for all that they disclose. Any and all priority claims identified in the Application Data Sheet, or any correction thereto, are hereby incorporated by reference under 37 CFR § 1.57.

TECHNICAL FIELD

The present inventions relate to diaphragm pumps, and more specifically to a multi-diaphragm pump.

DESCRIPTION OF THE RELATED ART

Diaphragm pumps are a type of positive displacement pump used to pump accurate amounts of chemical into water treatment plants. Diaphragm pumps can handle much higher system pressures than other positive displacement pump technologies, such as peristaltic pumps. Diaphragm pumps are common in the water treatment industry with one or more diaphragms. Multi-diaphragm pump designs are typically marketed in industry with separate inlets and outlets for each diaphragm. One benefit of multi-diaphragm pump designs is the capability to pump multiple chemicals with a single drive and controller.

SUMMARY

Certain embodiments have particularly advantageous applicability in connection with multi-diaphragm pumps that are configured with a single direct drive and controller.

BRIEF DESCRIPTION OF THE DRAWINGS

Various features of illustrative embodiments of the inventions are described below with reference to the drawings. The illustrated embodiments are intended to illustrate, but not to limit, the inventions. The drawings contain the following figures.

DETAILED DESCRIPTION

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

As noted above, embodiments of the present inventions can overcome several prior art deficiencies and provide advantageous results. Some embodiments provide for a multiple diaphragm pump that can operate at high pressures while maintaining a high flow rate. Some embodiments allow the multiple diaphragm pump to operate effectively at higher pressures and flow rates without requiring that the pump have a larger motor. Some embodiments of diaphragms that may be used with multiple diaphragm pumps according to the present inventions are discussed in U.S. Patent Application No. 61/919,556, entitled "A SEALING DIAPHRAGM AND METHODS OF MANUFACTURING SMD DIAPHRAGM," filed Dec. 20, 2013, which is hereby incorporated by reference in its entirety.

Figure 1:
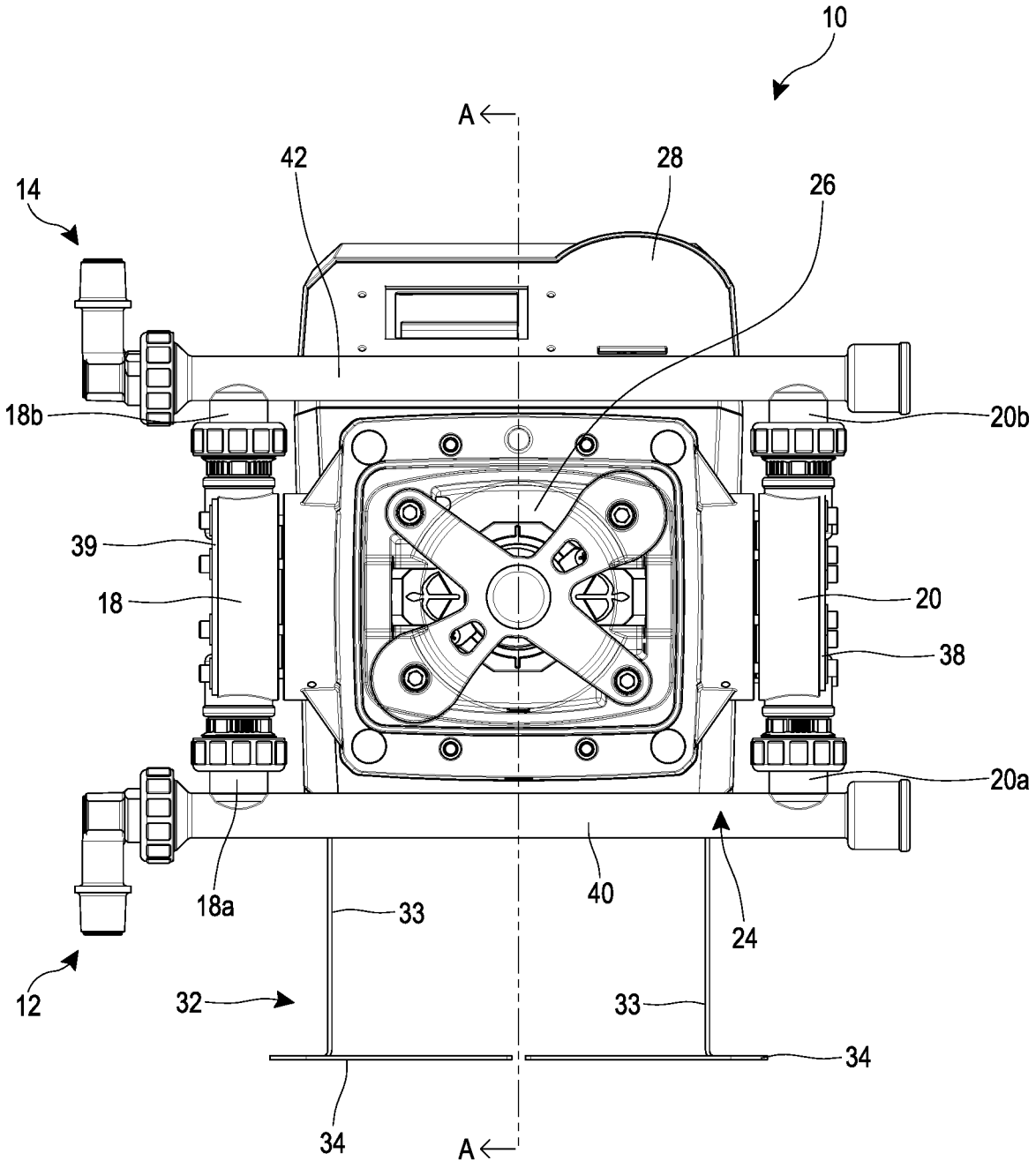
FIG. 1 is a front view of a pump assembly according to the present disclosure.
Figure 2:
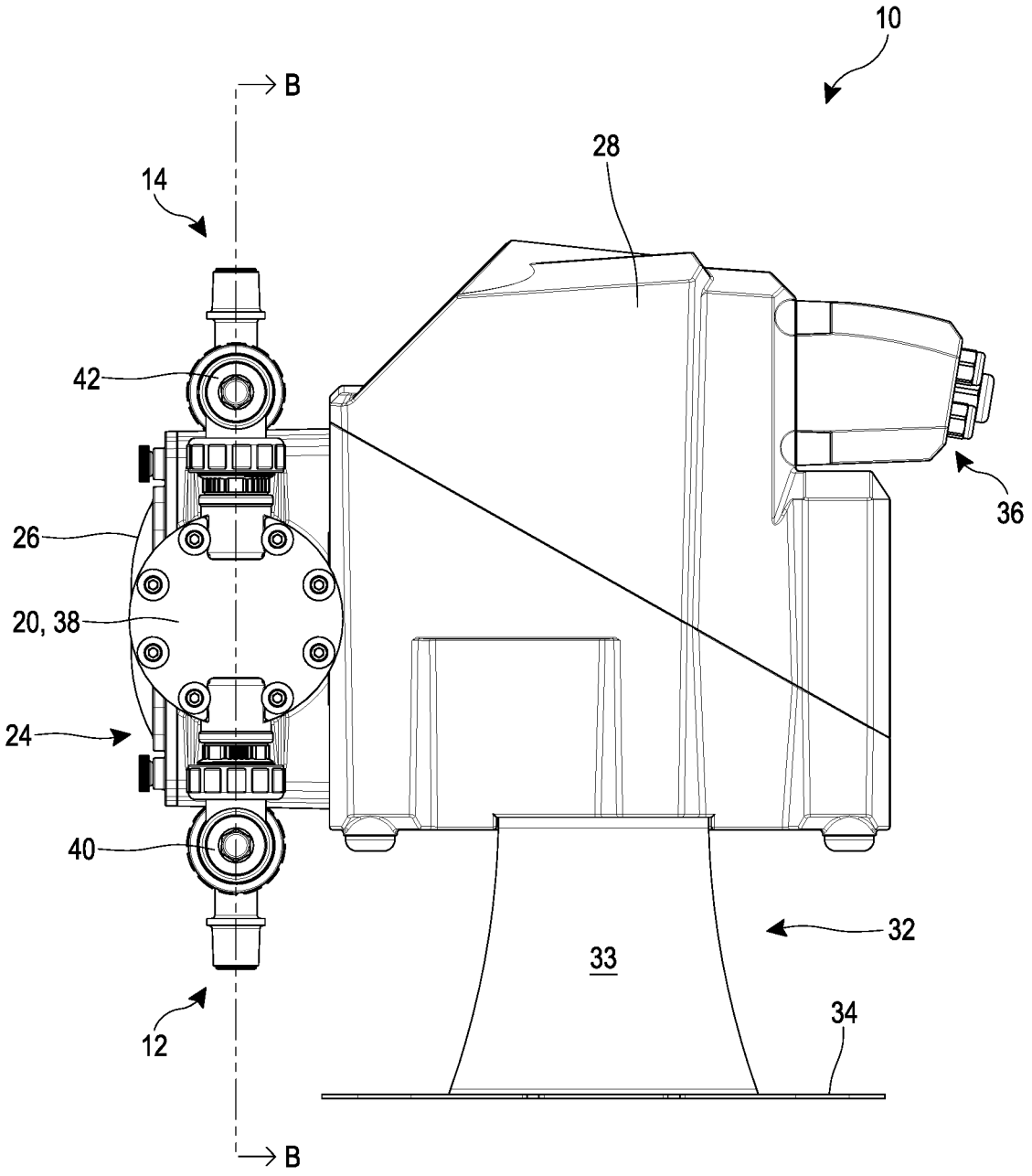
FIG. 2 is a right side view of the pump assembly of FIG. 1.

FIGS. 1 and 2 illustrate an embodiment of a diaphragm pump assembly 10. The assembly 10 can include an inlet 12 and an outlet 14. While the pump assembly 10 is illustrated as having a single inlet 12 and a single outlet 14, in some embodiments, the pump assembly 10 has additional inlets and/or outlets. In some embodiments, the pump assembly 10 has more inlets than outlets. In some embodiments, the pump assembly has more outlets than inlets. In some embodiments, the pump assembly has the same number of inlets and outlets.

The pump assembly 10 can include at least one pump chamber. As illustrated, the pump assembly 10 can include a first pump chamber 18 and a second pump chamber 20. The first and second pump chambers 18, 20 can be positioned in parallel to each other in fluid flow paths between the inlet 12 and the outlet 14. The pump assembly 10 can include an inlet connector passage 40 extending between an inlet 18*a* of the first pump chamber 18 and an inlet 20*a* of the second pump chamber 20. The inlet connector passage 40 can be configured to fluidly connect the first and second pump chambers 18, 20 to the inlet 12 of the pump assembly 10. The pump assembly 10 can include an outlet connector passage 42 extending between an outlet 18*b* of first pump chamber 18 and an outlet 20*b* of the second pump chamber 20. The outlet connector passage 42 can be configured to fluidly connect the first and second pump chambers 18, 20 to the outlet 14. In some embodiments, a first end cap 39 can be used to connect the first pump chamber 18 to the pump assembly 10. In some embodiments, a second end cap 38 can be used to connect the second pump chamber 20 to the pump assembly 10. In some embodiments, the first end cap 39 forms a boundary of the first pump chamber 18. In some embodiments, the second end cap 38 (as best seen in FIG. 2) forms a boundary of the second pump chamber 20.

The pump assembly 10 can include a drive assembly 24. The drive assembly 24 can be positioned between the first and second pump chambers 18, 20. The drive assembly 24 can be configured to drive pumps within the first and second pump chambers 18, 20 to pump fluid from the inlet 12 to the outlet 14. As illustrated in FIGS. 1 and 2, the drive assembly 24 can include a cover 26. The cover 26 can be positioned on a front side of the drive assembly 24. In some embodiments, the cover 26 is constructed from a transparent or translucent material (e.g., a polymer, glass, composite, or some combination thereof). Using a transparent or translucent material for the cover 26 can facilitate easier monitoring of the operation of the internal components of the drive assembly 24. The cover 26 can enclose a drive chamber 44 (FIG. 3) of the pump assembly 10. As illustrated, one or more components of the drive assembly 24 can be positioned at least partially within the drive chamber 44. In some embodiments, the drive chamber 44 is sealed (e.g., hermetically sealed) from an exterior of the pump assembly 10.

The drive assembly 24 can be positioned at least partially within a motor housing 28. In some embodiments, one or more of the drive assembly 24, first pump chamber 18, and second pump chamber 20 are positioned on a first side (e.g., front side, top side, left side, right side, back side, or bottom side) of the motor housing 28.

The pump assembly 10 can include a pump stand 32. The pump stand 32 can be configured to support the pump assembly 10 (e.g., the motor housing 28, the drive assembly 24, and/or the first and second pump chambers 18, 20). The pump stand 32 can comprise one or more legs 33 extending from motor housing 32. The legs 33 can include one or more feet 34 connected to ends of the legs 33 opposite the motor housing 28. In some embodiments, the pump assembly 10 is configured to be mounted to a wall, within a larger mounting, or otherwise.

As illustrated in FIG. 2, the motor housing 28 can include an electrical inlet 36. The electrical inlet 36 can be configured to facilitate passage of wires and other components from an exterior of the motor housing 28 into an interior of the motor housing 28. In some embodiments, the pump assembly 10 is configured to include one or more batteries to power operation of the pump assembly 10. In some such embodiments, the motor housing 28 does not include an electrical inlet. In some embodiments, the electrical inlet passes through one of the legs 33 or some other mounting device or structure of the assembly 10. The electrical inlet 36 can positioned on a back side, top side, bottom side, left side, rights side, or front side of the motor housing 28. In some embodiments, the electrical inlet 36 is connected to the drive assembly 24.

Figure 3:
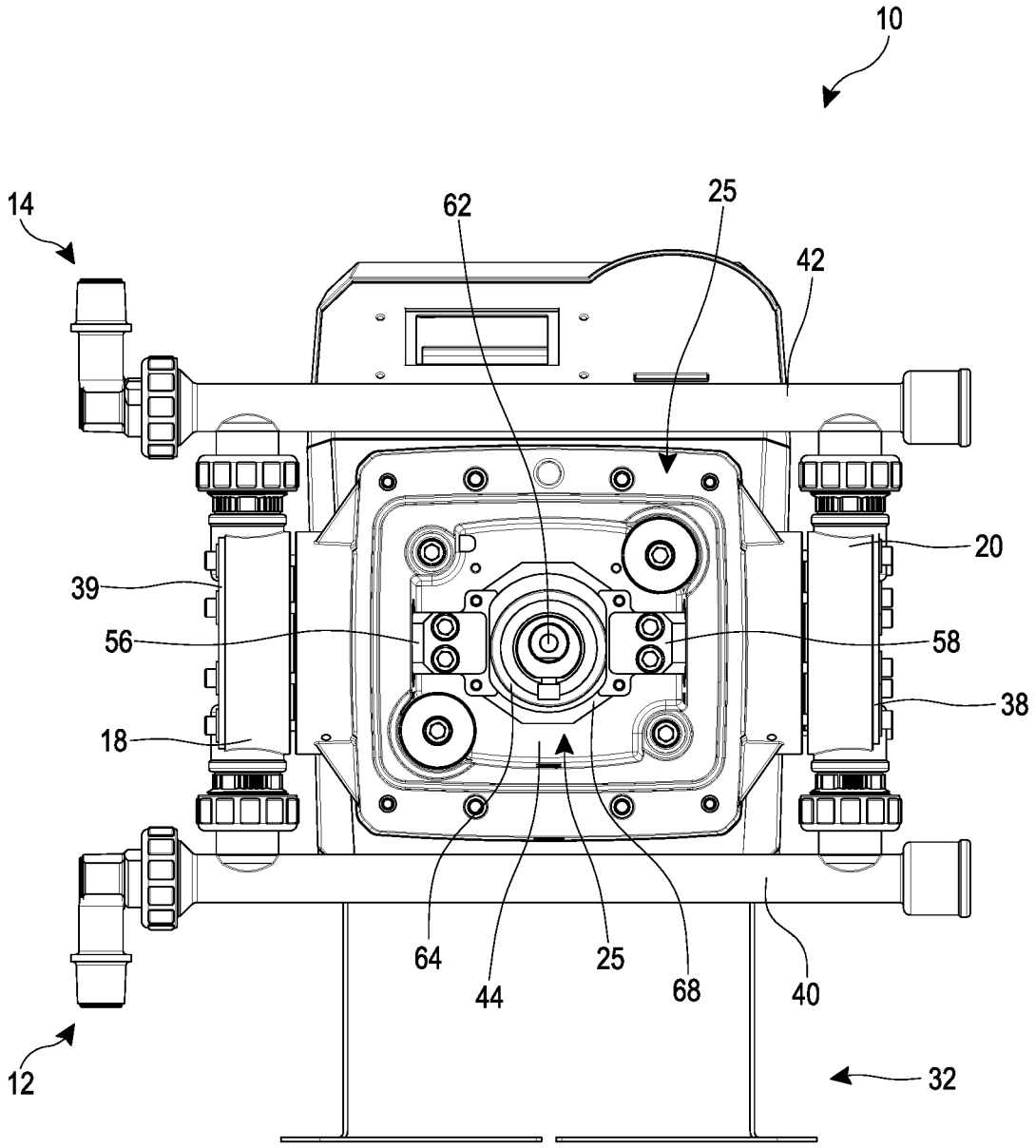
FIG. 3 is a front view of the pump assembly of FIG. 1, with the cover, shaft support, and yoke cover removed.

As illustrated in FIG. 3, the drive assembly 24 can include a drive unit 25 configured to move within the drive chamber 44. The drive unit 25 can be connected to one or more pistons. For example, the drive unit 25 can be connected to a first piston 56 and a second piston 58. The first piston 56 can be configured to affect the pressure within the first pump chamber 18. The second piston 58 can be configured to affect the pressure within the second pump chamber 20. The drive unit 25, first piston 56, second piston 58, and/or components thereof can be positioned at least partially within the drive chamber 44.

Figure 4:
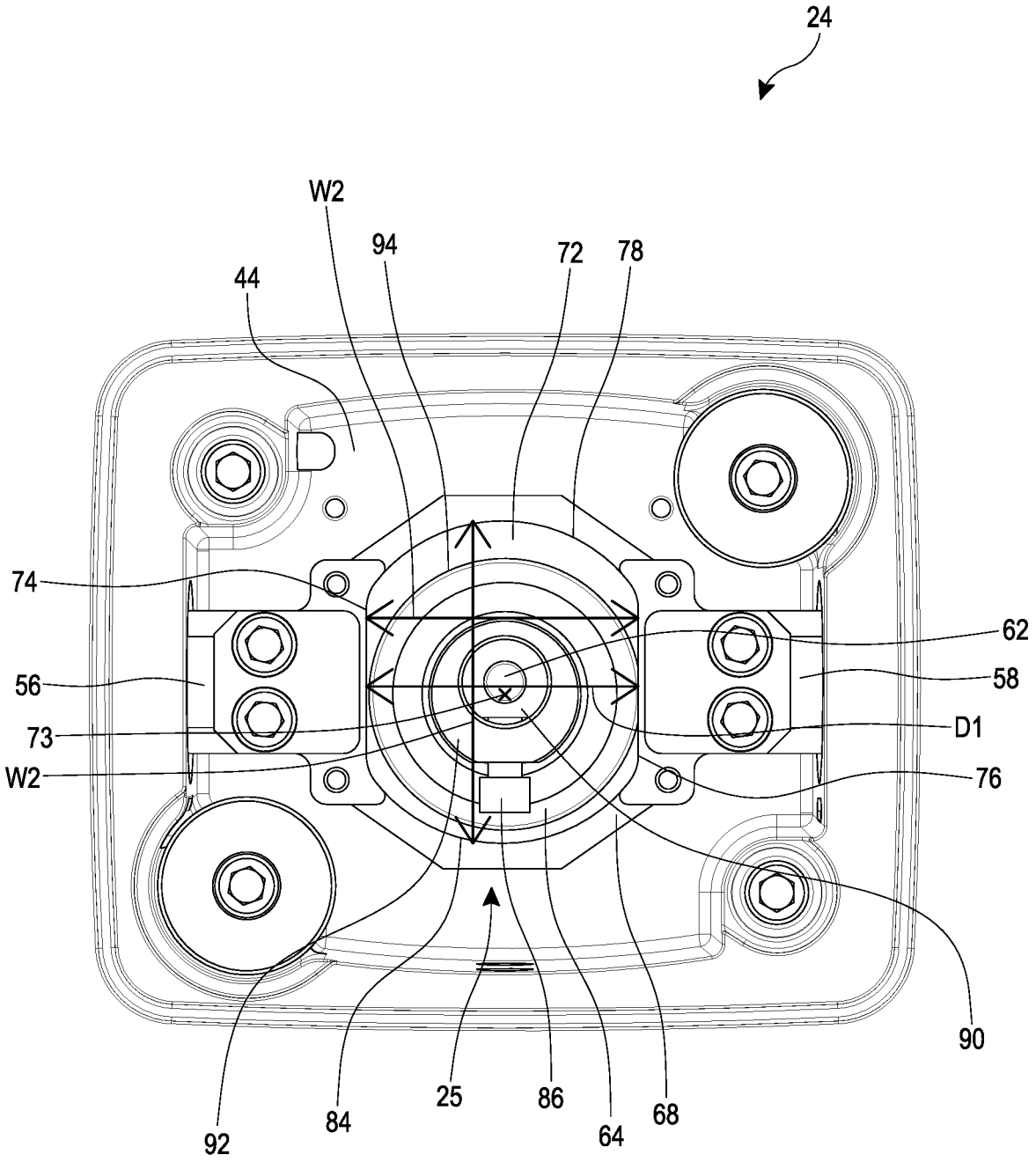
FIG. 4 is a close up view of the drive assembly of FIG. 3.
Figure 8:
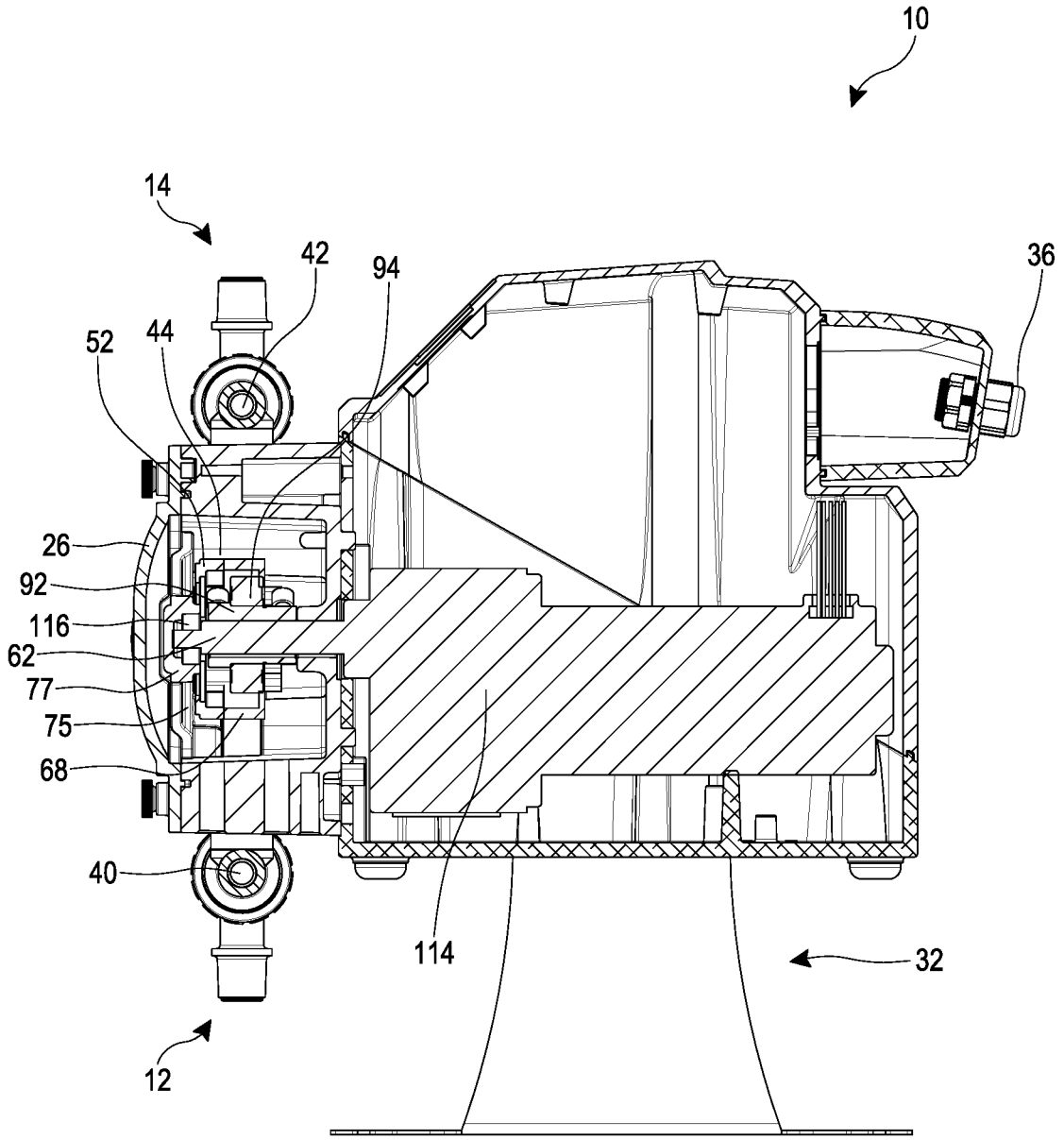
FIG. 8 is a cross-sectional view of the pump assembly of FIG. 1, taken along the cut-plane A-A of FIG. 1.

In some embodiments, the drive unit 25 includes a yoke 68. The yoke 68 can be directly or indirectly connected to one or both of the first and second pistons 56, 58. The drive unit 25 can include a cam 64. The cam 64 can be positioned at least partially within the yoke 68. The cam 64 can be connected to a drive shaft 62. The cam 64 can have a circular or substantially circular cross-sectional shape. As illustrated, the cam 64 can be offset from the drive shaft 62. For example, the center 73 (as best seen in FIG. 4) of the cam 64 can be offset from the rotational axis of the drive shaft 62 in a direction perpendicular to the rotational axis of the drive shaft 62. The drive shaft 62 can be configured to rotate in response to rotational input from the motor 114 (FIG. 8). The cam 64 can be configured to drive the yoke 68 in one or more directions in response to rotational input from the drive shaft 62. In some embodiments, the cam 64 is configured to rotate in unison with the drive shaft 62. Movement of the yoke 68, in turn, drives the first and second pistons 56, 58 in one or more directions.

As illustrated in FIG. 4, the yoke 68 can have a first wall 74, a second wall 76, a third wall 78 connecting the first and second walls, and a fourth wall 84 opposite the third wall and connecting the first and second walls. The walls of the yoke 68 can form an unbroken and/or uninterrupted perimeter surrounding a yoke pocket 72. Using a yoke 68 having a continuous perimeter can facilitate reliable movement of the pistons 56, 58 and can reduce the likelihood of failure of the yoke 68. The cam 64 (e.g., the offset cam) can be positioned partially or entirely within the yoke pocket 72 when observed from a point of view along the rotational axis of the drive shaft 62. The cam 64 can have an outer diameter D1. The outer diameter D1 of the cam 64 can be less than a distance W1 between the first and second walls 74, 76 of the yoke 68. In some embodiments, the outer diameter D1 of the cam 64 is between 60%-80%, between 75%-95%, between 85%-97%, between 96%-99%, and/or between 98%-99.5% of the distance W1 between the first and second walls 74, 76. In some embodiments, the outer diameter D1 of the cam 64 is less than the distance W1 between the first and second walls 74, 76 and the difference between the outer diameter D1 and the distance W1 is less than 10%, less than 8%, less than 6%, less than 4%, less than 2%, less than 1%, less than 0.5%, and/or less than 0.25% of the distance W1 between the first and second walls 74, 76 of the yoke 68.

In some embodiments, one or both of the first and second walls 74, 76 are flat. The first and second walls 74, 76 of the yoke 68 can be parallel to each other. As illustrated, the first and second walls 74, 76 of the yoke 68 can be perpendicular to direction of movement of the pistons 56, 58. In some embodiments, the cam 64 is sized such that, in the frame of reference of the yoke 68, the cam 64 does not travel a significant distance in a direction perpendicular to the walls 74, 76. For example, the diameter D1 of the cam 64 can be very close (e.g., within 5%, within 3%, within 1%, within 0.5%, and/or within 0.25%) of the distance W1 between the first and second walls 74, 76, such that there is very little room for the cam 64 to travel with respect to the yoke 68 in a direction perpendicular to the first and second walls 74, 76 of the yoke 68. Minimizing the travel of the cam 64 toward and away from the first and second walls 74, 76 can reduce impact of the cam 64 on those walls, thereby reducing noise and/or wear on the first and second walls 74, 76. One or more of the first wall 74, second wall 76, and outer surface of the offset cam 64 can be formed from and/or coated with a low friction and/or high toughness material to reduce the likelihood of failure of the offset cam 64 or walls of the yoke 68.

As explained above, the offset cam 64 is configured to rotate with the drive shaft 62. Preferably, rotation of the drive shaft 62 moves the center 73 of the offset cam 64 in a circular or arcuate path. Movement of the center 73 of the offset cam 64 causes the offset cam 64 to push against the first wall 74 over a portion (e.g., approximately ½ of a revolution of the drive shaft 62) of the rotation of the drive shaft 62 and to push against the second wall 76 over another portion (e.g., approximately ½ of a revolution of the drive shaft 62) of the rotation of the drive shaft 62. As the drive shaft rotates 62, the offset cam 64 can also move up and down (e.g., in the frame of reference of FIG. 4 and/or parallel to the first and second walls 74, 76) within the yoke pocket 72. To accommodate this motion, the distance W2 between the third and fourth walls 78, 82 (e.g., the max distance) can be greater than the diameter D1 of the offset cam 64. For example, the distance W2 between the third and fourth walls 78, 82 can be at least 10%, at least 15%, at least 20%, and/or at least 25% greater than the diameter D1 of the offset cam 64. The drive assembly 24 can be configured to operate with little or no lubrication. In some embodiments, the drive chamber 44 is a dry environment. Reducing or eliminating the need for lubricant or hydraulic environments can reduce the cost of the pump assembly 10 and reduce maintenance costs.

As illustrated in FIG. 4, the drive unit 25 can include a linkage 86 between the drive shaft 62 and the offset cam 64. The linkage 86 can be configured to rotationally lock the offset cam 64, or some portion thereof, to the drive shaft 62. For example, the linkage 86 can be a fastener inserted through an inner cam portion 92 and in contact with or extending through a portion of the outer portion 90 of the drive shaft 62.

Figure 9:
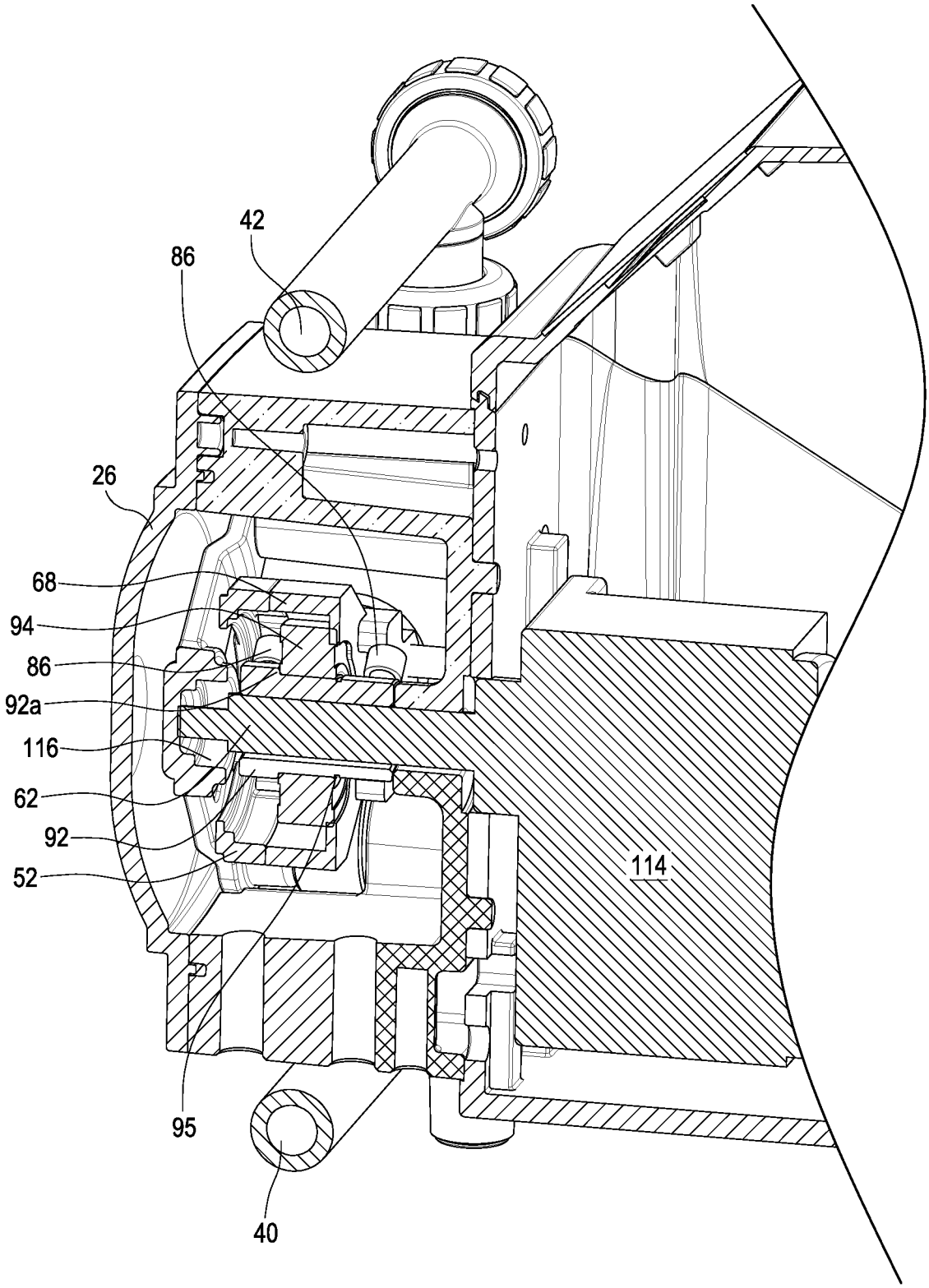
FIG. 9 is a perspective cross-sectional view of the pump assembly of FIG. 1, taken along the cut-plane A-A of FIG. 1.

A bearing 94 can be positioned surrounding the inner cam portion 92. In some embodiments, the bearing 94 is press-fit onto the inner cam portion 92. As illustrated in FIG. 9, the bearing 94 is positioned between a shoulder 92*a* of the inner cam portion 92 and a snap ring 95. The snap ring 95 can fit into a groove in an outer surface of the inner cam portion 92. In some embodiments, two linkages 86 are used to lock the inner cam portion 92 to the drive shaft 62. As illustrated, one linkage 86 can be positioned in front of the bearing 94 and a second linkage 86 can be positioned behind the bearing 94. The bearing 94 can form the contact surface of the offset cam 64 with the walls of the yoke 68. In some embodiments, the contact surface of the offset cam 64 is configured to rotate with respect to the inner cam portion 92. Rotation of the outer surface of the offset cam 64 with respect to the inner cam portion 92 and/or drive shaft 62 can reduce the friction between the offset cam 64 and the yoke 68. Reduction of friction between the offset cam 64 and the yoke 68 can reduce or eliminate the need for lubricant or other fluids in the drive chamber 44 between the offset cam 64 and yoke 68.

Figure 5:
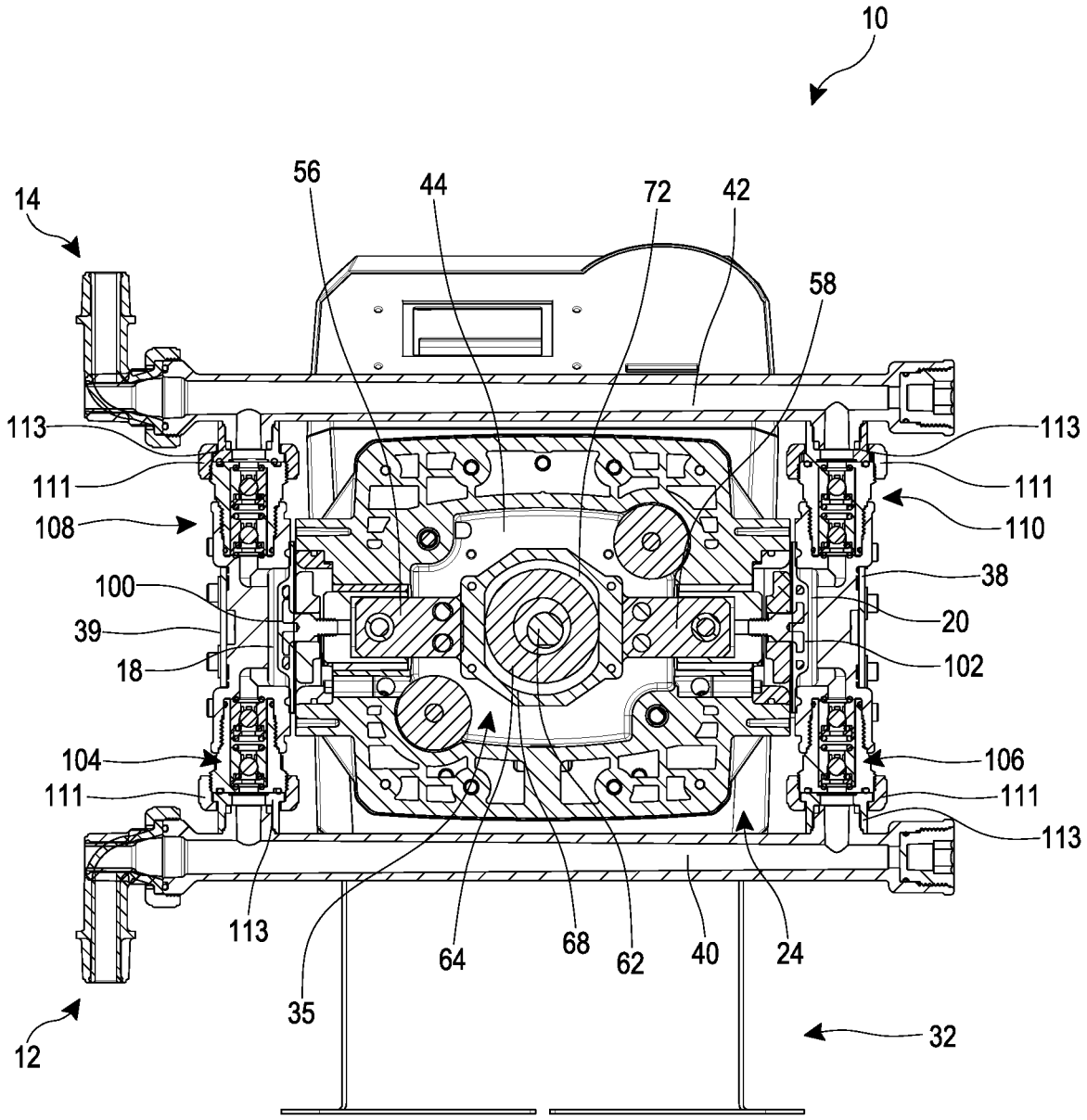
FIG. 5 is a cross-sectional view of the pump assembly of FIG. 1, taken along the cut-plane B-B of FIG. 2.

As illustrated in FIG. 5, the first piston 56 can be connected, directly or indirectly, to a first diaphragm 100 (e.g., a flexible wall). The second piston 58 can be connected to a second diaphragm 102 (e.g., a flexible wall). The first diaphragm 100 can form a portion of the boundary for the first pump chamber 18. The second diaphragm 102 can form a portion of the boundary for the second pump chamber 20.

The pump assembly 10 can include one or more one-way valves. For example, a first one-way valve 104 can be positioned in the fluid path between the inlet 12 and the first pump chamber 18. In some embodiments, the first one-way valve 104 is positioned in the fluid path between the inlet connector passage 40 and the first pump chamber 18. The first one-way valve 104 can be configured to inhibit or prevent flow from the first pump chamber 18 toward the inlet 12 and to allow flow from the inlet 12 into the first pump chamber 18. In some embodiments, the first one-way valve 104 is configured to permit fluid flow into the first pump chamber 18 from the inlet 12 when a cracking pressure is exceeded. A second one-way valve 106 can be positioned in the fluid path between the inlet 12 or inlet connector passage 40 and the second pump chamber 20. The second one-way valve 106 can be configured to operate in a same or similar manner as the first one-way valve 104 with respect to the second pump chamber 20 instead of the first pump chamber 18. A third one-way valve 108 can be positioned in the fluid path between the first pump chamber 18 and the outlet 14 or outlet connector passage 42. The third one-way valve 108 can inhibit or prevent fluid flow into the first pump chamber 18 from the outlet 14 or outlet connector passage 42. The third one-way valve 108 can be configured to permit flow from the first pump chamber 18 to the outlet 14 or outlet connector passage 42 when a cracking pressure is exceeded. The pump assembly 10 can include a fourth one-way valve 110 positioned in the fluid path between the second pump chamber 20 and the outlet 14 or outlet connector passage 42. The fourth one-way valve 110 can be configured to operate in the same or a similar manner as the third one-way valve 108 with respect to the second pump chamber 20 instead of the first pump chamber 18.

In some embodiments, union nuts 111 can be used to connect the one-way valves (e.g., the housings of the one-way valves) to ports 113 on the inlet and outlet connector passages 40, 42. The union nuts 111 can be spin-welded or otherwise affixed to the ports 113. Affixing the union nuts 111 to the ports 113 reduces the likelihood of loosening the connection between the one-way valves and the ports 113, thereby reducing the risk of leaks.

Figure 6:
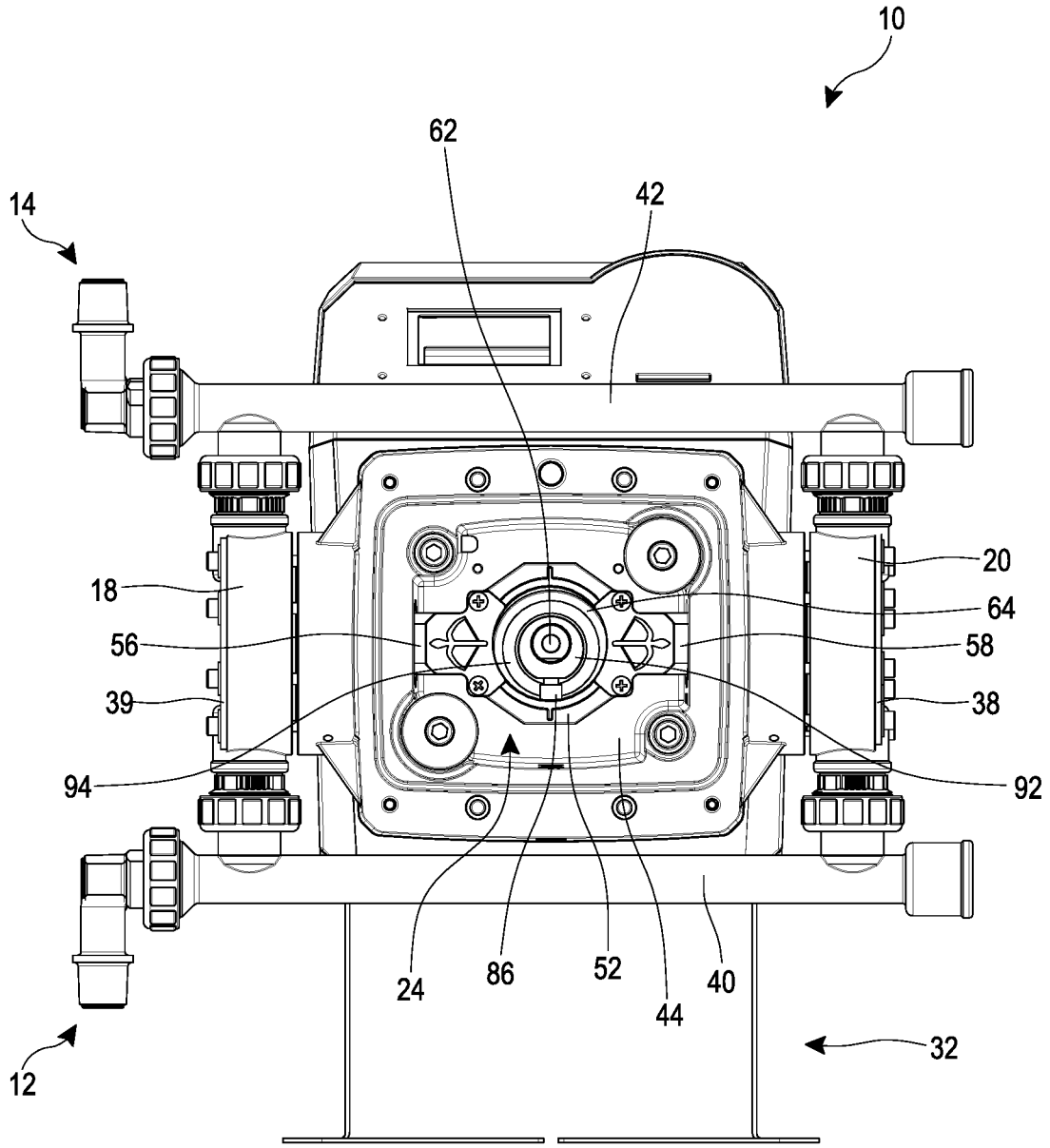
FIG. 6 is a front view of the pump assembly of FIG. 1, with the cover and shaft support removed.

As illustrated in FIG. 6, the drive assembly 24 can include a yoke cover 52. The yoke cover 52 can connect the yoke 68 to the pistons 56, 58. In some embodiments, the yoke cover 52 is configured to lock the yoke 68 to the pistons 56, 58 such that movement of the yoke 68 moves the pistons 56, 58 in unison with each other. The yoke cover 52 can be connected to the yoke 68 and pistons 56, 58 via one or more fasteners, welding, adhesives, clips, and/or other attachment methods and structures.

Figure 7:
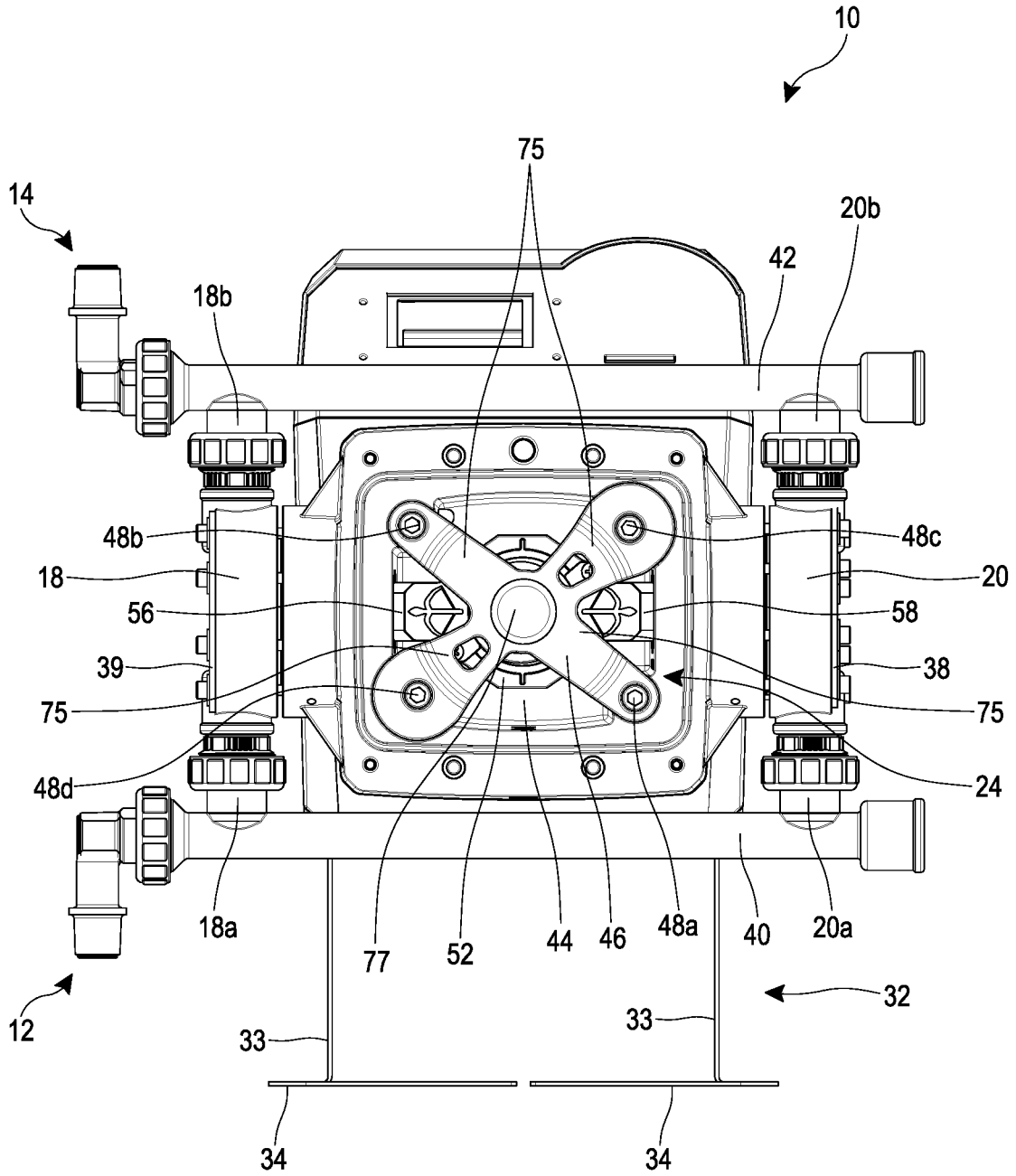
FIG. 7 is a front view of the pump assembly of FIG. 1, with the cover removed.

As illustrated in FIG. 7, the drive assembly 24 can include a shaft support 46. The shaft support 46 can include a central portion 77 and plurality of outer arms 75. Each of the arms 75 of the shaft support 46 can be connected to the motor housing 38 or other structure of the pump assembly 10. As illustrated, the shaft support 46 can have four arms 75 that can be connected to the motor housing 38 via four attachment points 48*a*, 48*b*, 48*c*, and 48*d*. The four attachment points can be arranged such that two pairs of attachment points (48*a*-48*b*, 48*c*-48*d*) each span the yoke 68. Arranging the attachment points spanning the yoke 68 in at least two pairs can facilitate even distribution of angular load on the shaft support 46 as the drive shaft 62 rotates in operation. Distributing load on the shaft support 46 in an even manner can reduce flexing of the drive shaft 62, thereby reducing the likelihood of drive shaft 62 failure. As illustrated in FIG. 8, the shaft support 46 (e.g., the central portion 77 of the shaft support 46) can connect to an end of the drive shaft 62 opposite the motor 114. The connection point between the drive shaft 62 and the shaft support 46 can be fixed. For example, the shaft support 46 can inhibit or prevent translation of the drive shaft in any direction perpendicular to the axis of rotation of the drive shaft 62. A bearing 116 can be positioned about the drive shaft 62 where the drive shaft 62 meets the shaft support 46. The bearing 116 can be a needle bearing, a ball bearing, or any other suitable bearing. The bearing 116 can be fixed in the directions perpendicular to the axis of rotation of the drive shaft 62. Fixing the bearing 116 and drive shaft 62 in directions perpendicular to the axis of rotation of the drive shaft 62 can increase stability of the drive shaft, increase durability of the bearing 116, reduce asymmetrical loading on the bearing 116 in directions perpendicular to the axis of rotation of the drive shaft 62, and/or reduce bending stress on the drive shaft 62. In some embodiments, this bearing 116 is the only load-bearing bearing used in connection with the drive shaft 62, offset cam 64, and yoke 68. Using only a single load-bearing bearing in this manner can reduce points of failure in the assembly 10 and increase the durability and/or reliability of the pump assembly 10. In some embodiments, the engagement between the drive shaft 62 and the shaft support 46 (e.g., the central portion 77 of the shaft support 46) does not include any bearings. For example, the drive shaft 62 and/or shaft support 46 can include low-friction surfaces at all or a portion of the interface between the drive shaft 62 and the shaft support 46.

The pump assembly 10 can be configured to operate in the following manner. As the drive shaft 62 rotates, the offset cam 64 can rotate and move toward the first pump chamber 18. Movement of the offset cam 64 toward the first pump chamber 18 can apply a pushing force on the first wall 74 of the yoke 68. Pushing on the first wall 74 can translate into a pushing force on the first piston 56. Pushing on the first piston 56 can push on the first diaphragm 100, thereby reducing the volume within the first pump chamber 18. Reduction in the volume of the first pump chamber 18 can increase the pressure in the first pump chamber 18, thereby opening the third one-way valve 108 to push fluid from the first pump chamber 18 toward the outlet. Concurrent with the pushing of the first piston 56 toward the first pump chamber 18, the second piston 58 is pulled by the yoke 68 away from the second pump chamber 20. Pulling of the second piston 58 away from the second pump chamber 20 pulls the second diaphragm 102 away from the second pump chamber 20 to increase the volume in the second pump chamber 20. Increasing the volume in the second pump chamber 20 reduces the pressure in the second pump chamber 20, causing the second one-way valve 106 to open and to allow fluid flow from the inlet 12 into the second pump chamber 20. As the drive shaft 62 continues to rotate, the cam 64 also rotates until it begins pushing against the second wall 76 of the yoke 68. This pushing on the second wall 76 causes the opposite movements and respective pressure changes from those described above in this paragraph. As such, as the drive shaft 62 completes is revolutions, the pump chambers 18, 20 alternately pull in fluid from the inlet 12 and push out fluid to the outlet 14.

The streamline designs of the pumps of the present disclosure allow for a number of additional advantages. For example, due to the relatively low number of parts, assembly of the pump assembly 10 can be accomplished quickly. Additionally, use of fewer parts (e.g., fewer moving parts, bearings, etc.) can increase the reliability of the pump assembly, as the potential points of failure are reduced For expository purposes, the term "horizontal" as used herein is defined as a plane parallel to the plane or surface of the floor of the area in which the system being described is used or the method being described is performed, regardless of its orientation. The term "floor" floor can be interchanged with the term "ground." The term "vertical" refers to a direction perpendicular to the horizontal as just defined. Terms such as "above," "below," "bottom," "top," "side," "higher," "lower," "upper," "over," and "under," are defined with respect to the horizontal plane.

As used herein, the terms "attached," "connected," "mated," and other such relational terms should be construed, unless otherwise noted, to include removable, moveable, fixed, adjustable, and/or releasable connections or attachments. The connections/attachments can include direct connections and/or connections having intermediate structure between the two components discussed.

The terms "approximately", "about", "generally" and "substantially" as used herein represent an amount close to the stated amount that still performs a desired function or achieves a desired result. For example, the terms "approximately", "about", "generally," and "substantially" may refer to an amount that is within less than 10% of the stated amount.

Although embodiments of these inventions have been disclosed in the context of certain examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions.

What is claimed is:

1. A diaphragm pump assembly comprising:

an assembly inlet;

an assembly outlet;

a first pump chamber positioned in a first fluid path between the assembly inlet and outlet;

a second pump chamber positioned in a second fluid path between the assembly inlet and outlet;

a first diaphragm positioned at least partially within the first pump chamber, the first diaphragm having a perimeter sealingly connected to one or more walls of the first pump chamber;

a second diaphragm positioned at least partially within the second pump chamber, the second diaphragm having a perimeter sealingly connected to one or more walls of the second pump chamber;

a first piston connected to the first diaphragm, the first piston movable linearly;

a second piston connected to the second diaphragm, the second piston movable linearly;

a pump drive chamber positioned between the first pump chamber and the second pump chamber;

a drive yoke connected to both the first and second pistons and positioned within the pump drive chamber, the drive yoke having a first drive wall and a second drive wall parallel to and opposing the first drive wall;

a motor;

a straight motor drive shaft having a first end connected to the motor and a second end extending through the pump drive chamber;

an offset cam having a cam diameter, the offset cam connected to the motor drive shaft and configured to rotate in unison with the motor drive shaft; wherein:

the offset cam is configured to push the drive yoke toward the first pump chamber during a first portion of one rotation of the straight motor shaft and to push the drive yoke toward the second pump chamber during a second portion of one rotation of the straight motor shaft;

movement of the drive yoke toward the first pump chamber forces a portion of the first diaphragm to move and to increase pressure in the first pump chamber;

movement of the drive yoke toward the first pump chamber forces a portion of the second diaphragm to move and to reduce pressure in the second pump chamber;

movement of the drive yoke toward the second pump chamber forces a portion of the first diaphragm to move and to reduce pressure in the first pump chamber;

movement of the drive yoke toward the second pump chamber forces a portion of the second diaphragm to move and to increase pressure in the second pump chamber;

a first one way valve positioned in a fluid path between the assembly inlet and the first pump chamber, the first one way valve configured to permit fluid flow from the assembly inlet into the first pump chamber and to inhibit fluid flow from the first pump chamber toward the assembly inlet;

a second one way valve positioned in a fluid path between the first pump chamber and the assembly outlet, the second one way valve configured to permit fluid flow from the first pump chamber toward the assembly outlet and to inhibit fluid flow from the assembly outlet into the first pump chamber;

a third one way valve positioned in a fluid path between the assembly inlet and the second pump chamber, the third one way valve configured to permit fluid flow from the assembly inlet into the second pump chamber and to inhibit fluid flow from the second pump chamber toward the assembly inlet; and a fourth one way valve positioned in a fluid path between the second pump chamber and the assembly outlet, the fourth one way valve configured to permit fluid flow from the second pump chamber toward the assembly outlet and to inhibit fluid flow from the assembly outlet into the second pump chamber, and wherein:

the offset cam is configured to push against the first drive wall in a first direction during the first portion of a rotation of the straight motor shaft and to push against the second drive wall in a second direction during the second portion of the rotation of the straight motor drive shaft, wherein the first direction and the second direction are collinear; and (1) the first piston moves linearly toward the first diaphragm when the offset cam pushes against the first drive wall of the drive yoke in a manner which is collinear with the first direction and the second direction, and (2) the second piston moves linearly in a manner which is collinear with the first direction and the second direction.

2. The diaphragm pump assembly of claim 1, comprising a motor shaft support positioned on a side of the drive yoke opposite the motor and configured to support the straight motor shaft.

3. The diaphragm pump assembly of claim 2, wherein the motor shaft support includes an anti-friction bearing configured to engage the straight motor shaft and reduce friction between the straight motor shaft and the motor shaft support during rotation of the straight motor shaft.

4. The diaphragm pump assembly of claim 2, comprising a housing within which the pump drive chamber is positioned, wherein the motor shaft support includes two pairs of attachments configured to attach the motor shaft support to the housing, wherein each pair of attachments spans the drive yoke in a direction parallel to the first drive wall and in a direction perpendicular to the first drive wall.

5. The diaphragm pump assembly of claim 1, wherein the assembly includes only one load-bearing bearing for the straight motor shaft.

6. A diaphragm pump assembly comprising:

a first diaphragm chamber having an inlet, an outlet, and a first flexible wall;

a second diaphragm chamber having an inlet, an outlet, and a second flexible wall;

a pump drive chamber positioned between the first and second diaphragm chambers;

a drive yoke positioned within the pump drive chamber and having a first flat wall, a second flat wall parallel to and facing the first flat wall, a third wall connecting the first flat wall to the second flat wall, and a fourth wall opposite the third wall and connecting the first flat wall to the second flat wall;

a motor;

a straight motor shaft connected to the motor and extending into the pump drive chamber between the first and second flat walls and between the third and fourth walls of the drive yoke;

an offset cam configured to rotate in response to rotation of the straight motor shaft and positioned between the first and second flat walls;

a first piston connected to the first flexible wall and to the drive yoke; and a second piston connected to the second flexible wall and to the drive yoke; wherein:

the offset cam is configured to push against the first flat wall in a first direction during a first portion of a rotation of the straight motor shaft and to push against the second flat wall in a second direction during a second portion of the rotation of the straight motor shaft, wherein the first direction and the second direction are collinear;

the first piston moves linearly toward the first flexible wall when the offset cam pushes against the first flat wall of the drive yoke, wherein linear movement of the first piston is collinear with the first direction and the second direction;

movement of the first piston toward the first flexible wall increases pressure within the first diaphragm chamber;

the second piston moves linearly away from the second flexible wall when the offset cam pushes against the first flat wall of the drive yoke, wherein linear movement of the second piston is collinear with the first direction and the second direction;

movement of the second piston away from the second flexible wall reduces pressure within the second diaphragm chamber;

the first piston moves away from the first flexible wall when the offset cam pushes against the second flat wall of the drive yoke;

movement of the first piston away from the first flexible wall reduces pressure within the first diaphragm chamber;

the second piston moves toward the second flexible wall when the offset cam pushes against the second flat wall of the drive yoke;

movement of the second piston toward the second flexible wall increases pressure within the second diaphragm chamber.

7. The diaphragm pump assembly of claim 6, wherein the first piston is connected to a center of the first flexible wall and the second piston is connected to a center of the second flexible wall.

8. The diaphragm pump assembly of claim 6, wherein the offset cam has a circular shape.

9. The diaphragm pump assembly of claim 6, wherein an interior of the pump drive chamber is not filled with liquid.

10. The diaphragm pump assembly of claim 6, wherein the drive yoke is configured to move in only two collinear directions.

11. The diaphragm pump assembly of claim 6, wherein the pump drive chamber is fluidly isolated from both the first and second diaphragm chambers.

12. The diaphragm pump assembly of claim 6, comprising an assembly inlet and an assembly outlet, wherein the first and second diaphragm chambers are positioned in parallel with each other in a fluid path between the assembly inlet and the assembly outlet.

13. The diaphragm pump assembly of claim 6, wherein the drive yoke defines a yoke frame defining the first flat wall, the second flat wall, the third wall and the fourth wall; and a yoke pocket surrounded by the yoke frame, the yoke pocket having a height, a width measured parallel to the first direction and passing through an axis of rotation of the straight motor shaft to the first flat and second flat walls; and a diameter of the offset cam is less than the width of yoke pocket and the diameter of the offset cam is within 5% of the width of the yoke pocket.

* * * * *